US009394709B2

(12) United States Patent
Iosim

(10) Patent No.: US 9,394,709 B2
(45) Date of Patent: Jul. 19, 2016

(54) SWIMMING POOL AND SPA COVER APPARATUS AND METHOD THEREOF

(76) Inventor: Mark Iosim, Hooksett, NH (US)

( * ) Notice: Subject to any disclaimer, the term of this patent is extended or adjusted under 35 U.S.C. 154(b) by 697 days.

(21) Appl. No.: 12/759,087

(22) Filed: Apr. 13, 2010

(65) Prior Publication Data

US 2011/0113546 A1 May 19, 2011

Related U.S. Application Data

(60) Provisional application No. 61/281,205, filed on Nov. 16, 2009.

(51) Int. Cl.
*E04H 4/10* (2006.01)
*E04H 4/08* (2006.01)

(52) U.S. Cl.
CPC ..... *E04H 4/108* (2013.01); *E04H 4/084* (2013.01)

(58) Field of Classification Search
USPC ..... 4/494, 498, 500, 503, 504; 135/123, 135/158, 119, 120.1–120.4
See application file for complete search history.

(56) References Cited

U.S. PATENT DOCUMENTS

| | | | | |
|---|---|---|---|---|
| 2,912,703 | A | 11/1959 | Murphy | |
| 2,996,729 | A | 8/1961 | Bailey | |
| 3,009,166 | A * | 11/1961 | Sears | 4/494 |
| 3,041,631 | A | 7/1962 | Fogle | |
| 3,051,964 | A | 9/1962 | Fisher et al. | |
| 3,143,122 | A | 8/1964 | Goodrich | |
| 3,227,422 | A | 1/1966 | Loeb | |
| 3,285,257 | A * | 11/1966 | Tombari et al. | 135/148 |
| 3,435,465 | A | 4/1969 | Formel | |
| 3,461,890 | A | 8/1969 | Goodrich | |
| 3,564,622 | A | 2/1971 | Meulekamp | |
| 3,566,420 | A | 3/1971 | Peterson et al. | |
| 3,760,432 | A | 9/1973 | Glorisi | |
| 3,780,385 | A | 12/1973 | Dunn | |
| 3,895,400 | A | 7/1975 | Kelcey | |
| 4,051,638 | A | 10/1977 | Heintz | |
| 4,106,134 | A | 8/1978 | Schiron et al. | |
| 4,109,325 | A | 8/1978 | Shuff | |
| 4,165,543 | A | 8/1979 | Reinert | |
| 4,283,801 | A | 8/1981 | Smith | |
| 4,349,040 | A | 9/1982 | Miller | |

(Continued)

FOREIGN PATENT DOCUMENTS

| | | |
|---|---|---|
| CA | 2442831 A1 | 9/2003 |
| EP | 0031333 A1 | 7/1981 |

(Continued)

*Primary Examiner* — Janie Loeppke
(74) *Attorney, Agent, or Firm* — Hayes Soloway PC

(57) ABSTRACT

An apparatus and method for a swimming pool cover is provided. At least two stationary support members are located proximate to a swimming pool and rises vertically above the swimming pool. A substantially rigid cover element frame is supported by said support members and is movable in a substantially vertical direction between a lowered position proximate to the top surface of the swimming pool and a raised position remote from the top surface of the swimming pool. A flexible cover element is supported by said cover element frame, wherein the flexible cover element is stretched proximate to said cover element frame. A collapsible upper vertex is formed within the cover element to prevent a quantity of precipitation from collecting on top of the cover element. A vertical movement control system is located partially within at least one of the support members and controls movement of the cover element frame.

16 Claims, 14 Drawing Sheets

(56) References Cited

U.S. PATENT DOCUMENTS

| | | | |
|---|---|---|---|
| 4,426,744 | A | 1/1984 | Love |
| 4,598,506 | A | 7/1986 | Nohl et al. |
| 5,067,182 | A | 11/1991 | Koelsch |
| 5,107,552 | A | 4/1992 | Lavalliere et al. |
| 5,168,584 | A | 12/1992 | Peebles |
| 5,259,077 | A | 11/1993 | Hager et al. |
| 5,303,527 | A | 4/1994 | Perez et al. |
| 5,426,899 | A | 6/1995 | Jones |
| 5,546,972 | A | 8/1996 | Wardell et al. |
| 5,621,926 | A | 4/1997 | La Madeleine |
| 5,630,572 | A | 5/1997 | Guay |
| 5,680,893 | A | 10/1997 | Neer |
| 5,689,841 | A | 11/1997 | Black et al. |
| 5,887,296 | A | 3/1999 | Handwerker |
| 5,970,531 | A | 10/1999 | Demby |
| 6,109,283 | A | 8/2000 | Burke et al. |
| 6,374,550 | B1 | 4/2002 | Reus |
| 6,718,566 | B1 | 4/2004 | Wilson |
| 6,832,395 | B1 | 12/2004 | Jeffcoat |
| 6,836,907 | B1 | 1/2005 | Pesta |
| 7,204,291 | B2 | 4/2007 | Last |
| 7,263,805 | B2 | 9/2007 | Chapus |
| 7,614,093 | B2 | 11/2009 | Piche et al. |
| 2003/0014927 | A1 | 1/2003 | Brooks |
| 2006/0090403 | A1 | 5/2006 | Enos |
| 2007/0017017 | A1 | 1/2007 | Piche et al. |
| 2007/0044388 | A1 | 3/2007 | Lajoie et al. |
| 2008/0256698 | A1 | 10/2008 | Smart |
| 2008/0282460 | A1 | 11/2008 | Del Valle |
| 2009/0019799 | A1 | 1/2009 | Sarrat |

FOREIGN PATENT DOCUMENTS

| | | | |
|---|---|---|---|
| WO | 81/00129 | A1 | 1/1981 |
| WO | 2007012176 | A1 | 2/2007 |

* cited by examiner

SWIMMING POOL AND SPA COVER APPARATUS AND METHOD THEREOF

CROSS REFERENCE TO RELATED APPLICATION

This application claims benefit of U.S. Provisional Application Ser. No. 61/281,205 filed Nov. 16, 2009, the entire disclosure of which is incorporated herein by reference.

FIELD OF THE DISCLOSURE

The present disclosure is generally related to enclosures and more particularly is related to a swimming pool and spa cover apparatus and method thereof.

BACKGROUND OF THE DISCLOSURE

About 3,000 young children accidentally fall into swimming pools every year, and about 300 of them drown. Many proposals have been advanced to prevent such unfortunate occurrences and in many cases it has been suggested (and in many communities it is mandatory) to build fences around swimming pools. One proposal is to cover the pool when it is not in use, which may not only prevent accidents but may also be useful in keeping dirt out of the pool, preventing evaporation of the pool water and in maintaining the elevated temperature of the water in a pool.

Generally, pool covers must be manually secured to the surrounds of a pool, and are therefore inconvenient to a user of a pool since it may take considerable effort and time. Because of this inconvenience, many users will opt to not cover their pool, or may only cover their pool when it is not being used for an extended period of time. This may leave open the possibility of unintended injuries from accidental falls into the pool. Additionally, uncovered pools may accumulate debris and other foreign matter. Automated pool covers are known within the art, but they very costly, sometimes costing as much as the swimming pool itself. Furthermore, manual and automated pool covers are frequently unsightly and tend to ruin the architectural style of a pool or the surrounding landscaping, especially with pools located on high-end properties or commercial sites such as hotels.

Traditional pool covers may also fail to provide the level of safety that is sought by pool owners. Commonly, pool covers are constructed from a flexible waterproof material that is exposed to precipitation. After a short period of rain, the pool covers may start to accumulate the rainwater due to the weight of the rainwater forming a sagging, concave surface. This collected rainwater may pose yet another threat to children who are susceptible to falling into the concave surface of the pool cover and drowning in the accumulated water. In addition, the sagging, concave portion of the flexible cover becomes a collector of debris that is often difficult to remove.

Pools are generally constructed indoors, outdoors, or half indoors and half outdoors. Pools that are constructed indoors offer the benefit of year-round use, but require considerable investment in building not only the pool, but also the surrounding structure. Outdoor pools may be less costly than indoor pools, but they may only be used a few short months out of the year in certain climates. An outdoor hot tub or spa may be able to be used for the entire year, as they are equipped with a heater and a thermo cover. The thermo cover may help keep the water temperature at a desired level, but these covers are frequently bulky and inconvenient to use, since they are heavy and cumbersome.

Thus, a heretofore unaddressed need exists in the industry to address the aforementioned deficiencies and inadequacies.

SUMMARY OF THE DISCLOSURE

Embodiments of the present disclosure provide a swimming pool cover apparatus. Briefly described, in architecture, one embodiment of the apparatus, among others, can be implemented as follows. The system contains at least two stationary support members located proximate to a swimming pool and rising vertically above a top surface of the swimming pool. A substantially rigid cover element frame is supported by the support members and is movable in a substantially vertical direction between a lowered position proximate to the top surface of the swimming pool and a raised position remote from the top surface of the swimming pool. At least one flexible cover element is supported by said cover element frame, wherein the flexible cover element is stretched proximate to said cover element frame. At least one collapsible upper vertex is formed within the cover element, the upper vertex preventing a quantity of precipitation from collecting on top of the cover element, wherein the upper vertex is situated to collapse under a predetermined weight, whereby at least a portion of the cover element abuts an upper water surface of the swimming pool when the cover element frame is in the lowered position. A vertical movement control system is located at least partially within at least one of the support members, the vertical movement control system controlling a vertical movement of the cover element frame between the lowered position and the raised position.

The present disclosure can also be viewed as providing methods of covering a swimming pool. In this regard, one embodiment of such a method, among others, can be broadly summarized by the following steps: providing at least two stationary support members proximate to a swimming pool, wherein the support members rise vertically above a planar surface of the swimming pool; supporting a substantially rigid cover element frame with said support members; supporting at least one flexible cover element with said cover element frame, wherein the cover element is stretched proximate to said cover element frame; preventing a quantity of precipitation from collecting on top of the cover element with at least one collapsible upper vertex is formed within the cover element, wherein the upper vertex is situated to collapse under a predetermined weight, whereby at least a portion of the cover element abuts an upper water surface of the swimming pool when the cover element frame is in the lowered position; moving the cover element frame in a substantially vertical direction between a raised position remote from the top surface of the swimming pool and a lowered position proximate to a top surface of the swimming pool; and controlling a vertical movement of the cover element frame between the raised position and the lowered position with a vertical movement control system located at least partially within at least one of the support members.

The present disclosure can also be viewed as providing a spa cover apparatus. Briefly described, in architecture, one embodiment of the apparatus, among others, can be implemented as follows. The apparatus contains at least two stationary support members located proximate to a spa and rising vertically above a planar surface of the spa. At least one roof element is supported by the support members, wherein the roof element is located vertical to the spa. At least one cover element is supported by at least one of said support members and said roof element, the cover element moveable in a substantially vertical direction between a lowered position proximate to the top surface of the spa and a raised position remote from the top surface of the spa. A vertical movement control system is located at least partially within at least one of the support members and the roof element, the vertical movement control system controlling a vertical movement of the cover element between the lowered position and the raised position.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
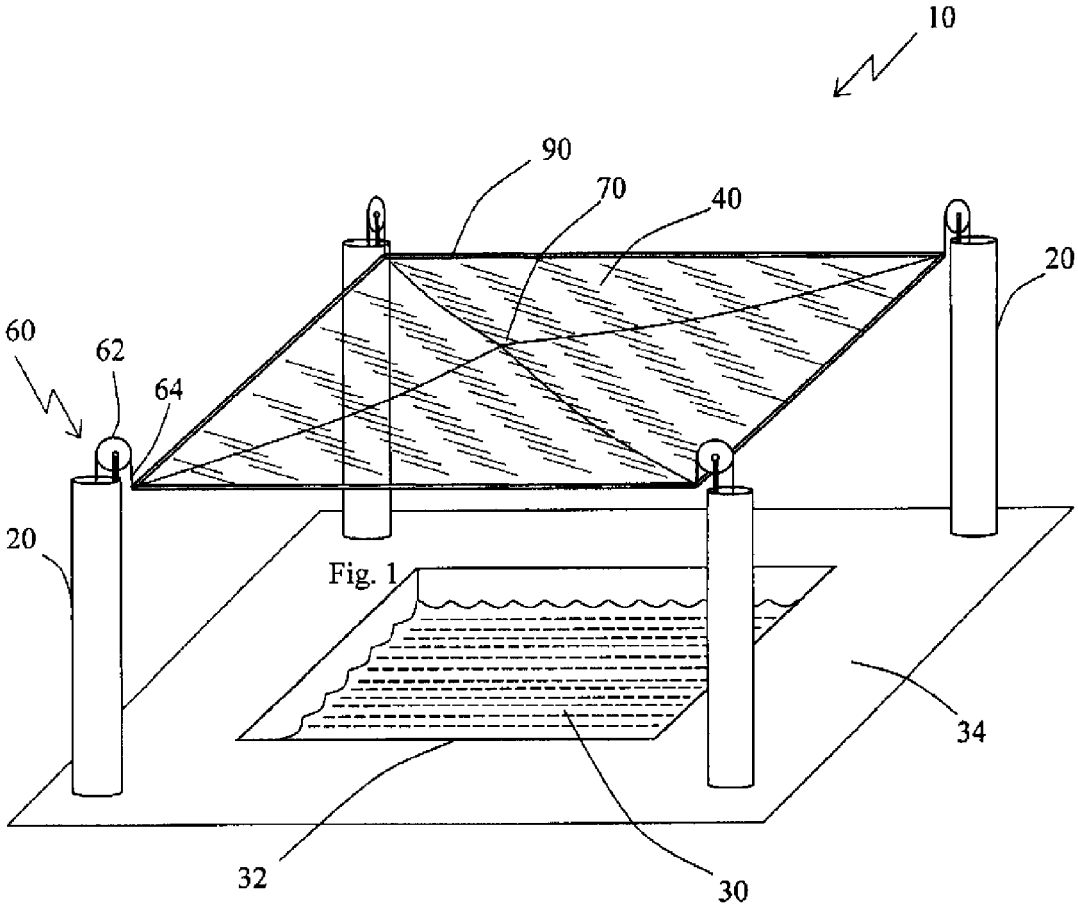
FIG. 1 is a plan view illustration of a swimming pool cover apparatus, in accordance with a first exemplary embodiment of the present disclosure.

FIG. 1 is a plan view illustration of a swimming pool cover apparatus 10, in accordance with a first exemplary embodiment of the present disclosure. The swimming pool cover apparatus 10 is used to cover and partially or fully enclose a swimming pool. In accordance with this disclosure, a swimming pool may include a variety of water-filled pools, including an aboveground swimming pool, an in-ground swimming pool, a partially in-ground swimming pool, a wading pool, a spa or any other water-filled container that may be used for swimming or a water-based recreation activity.

As illustrated in FIG. 1, the swimming pool cover apparatus 10 includes at least two stationary support members 20 located proximate to a swimming pool 30. The support members 20 rise vertically above a top surface of the swimming pool 30. The support members 20 support a substantially rigid cover element frame 90. The cover element frame 90 is movable in a substantially vertical direction between a lowered position proximate to the top surface 32 of the swimming pool 30 and a raised position remote from the top surface 32 of the swimming pool 30. At least one flexible cover element 40 is located substantially above the swimming pool 30 and supported by the cover element frame 90. The flexible cover element 40 is stretched proximate to the cover element frame 90. At least one collapsible upper vertex 70 is formed within the cover element 40. The upper vertex 70 prevents a quantity of precipitation from collecting on top of the cover element 40 and is situated to collapse under a predetermined weight, whereby at least a portion of the cover element 40 abuts an upper water surface of the swimming pool 30 when the cover element frame 90 is in the lowered position. A vertical movement control system 60 is located at least partially within at least one of the support members 20 and controls a vertical movement of the cover element frame 90 between the lowered position and the raised position.

The support members 20 may include a variety of supporting structures, including posts, columns and other vertically disposed structures, all of which are considered within the scope of the present disclosure. The support members 20 may be constructed from any material or combination of materials capable of supporting the cover element 40, including wood, wood composite, metallic compounds, plastics, synthetic materials or any combination thereof. The support members 20 may also have additional functions beyond supporting the cover element 40. For example, the support members 20 may include a lighting fixture and serve as a lamppost illuminating the area surrounding the swimming pool. The support members 20 may also include one or more horizontal connecting structures (not shown) affixed between two or more support members 20. These connecting structures may help maintain the structural integrity of the swimming pool cover apparatus 10. Additionally, the support members 20 may include architectural designs, aesthetic designs or any additional features that do not compromise the structural integrity. This may include architectural features that provide a three-dimensional effect with two-dimensional decorative components.

The support members 20 may preferably include a plurality of hollow posts located around the perimeter of the swimming pool 30. FIG. 1 illustrates four support members 20 located on a pool deck 34 of the swimming pool 30, although any number of support members 20 may be included and the support members 20 may be located proximate to a swimming pool 30 in any configuration. The support members 20 include a substantially hollow interior portion, which at least partially houses the vertical movement control system 60. The hollow interior portion of the support members 20 may be any size or dimension, such as a fully hollow interior portion, a small hollowed cavity within the support members 20, or any configuration in between.

As illustrated, the support members 20 rise vertically above a top surface 32 of the swimming pool 30. The top surface 32 may be characterized as the planar surface of a pool deck 34, but may also include other planar surfaces, such as the surface of the water within the swimming pool 30. The support members 20 may be appropriately secured proximate to the pool in any fashion, such as with a threaded fastener, a structural fastener or by being secured below the top surface 32. For example, the support members 20 may be affixed partially below the top surface 32 such as by being secured within a hole in the pool deck 34. The support members 20 may also be located entirely above the top surface 32, which may allow the swimming pool cover apparatus 10 to be installed to an existing pool deck 34 in a convenient and efficient manner without extensive alterations to the pool deck 34.

The support members 20 support a substantially rigid cover element frame 90. The cover element frame 90 may include any substantially rigid structure that is located above the swimming pool 30 and situated to support the cover element 40 between the various members of the cover element frame 90. The cover element frame 90 may include any number of supporting structures configured in any design, such as with diagonal cross members, parallel cross members, perpendicular cross members, or any combination thereof. The cover element frame 90 retains the flexible cover element 40 in a stretched position proximate to the cover element frame 90. This may include positions above or below the cover element frame 90, or any combination thereof. As the cover element 40 is stretched proximate to the cover element frame 90, it will have an open position, which covers at least a portion of the swimming pool 30. The cover element frame 90 may be constructed from any material, such as a metallic alloy, a composite material, lightweight plastic or any other suitable material. For example, the frame 90 may be constructed of hollow plastic tubes that are formed about the perimeter of the cover element 40. The plastic tubes may be integral with each other or affixed together, thereby forming an enclosed cavity within the interior portion of the tubes. As will be discussed further, with respect to FIGS. 6 and 7, the enclosed cavity may act as a container for housing a counterbalancing weight, such as water.

At least one cover element 40 is supported by the cover element frame 90 in a location substantially above the swimming pool 30. The cover element 40 is constructed from a flexible, waterproof material that is preferably transparent, or substantially transparent, and preferably has minimal or substantially no elasticity. For example, the cover element 40 may be constructed from one or more 10-50 ml thick plastic sheets of PVC or polyethylene. As one having ordinary skill in the art would recognize, many varieties and types of materials may be suitable for the cover element 40, all of which are considered within the scope of the present disclosure. The cover element 40 may include one structure or a plurality of structures, as varied by design. The cover element 40 is stretched proximate to the cover element frame 90, whereby the cover element 40 forms an open cover situated above the swimming pool 30. For example, the cover element 40 may be stretched over the cover element frame 90 or between cover element frame 90 members. It is noted that the cover element 40 must be sufficiently stretched proximate to the cover element frame 90 whereby the system 10 can take advantage of the water-displacement with surface tension effect, as discussed further with respect to FIG. 5. Accordingly, the more the cover element 40 is stretched, the more weight is can support. A cover element 40 that is considered sufficiently stretched may will depend on the cover element 40 material and size, and the size of the swimming pool 30, among other things.

The cover element 40 may be retained stretched proximate to the cover element frame 90 with any number or type of fasteners. In this configuration, the cover element 40 and cover element frame 90 may be capable of being easily moved in a substantially vertical direction. The cover element 40 is preferably waterproof and water resistant and preferably at least substantially transparent, and thus capable of permitting solar energy to pass through to water within the swimming pool 30. This may allow the cover element 40 to act as a solar heating barrier for the swimming pool 30. Although certain features are preferable with the cover element 40, any structure that is capable of being stretched proximate to the cover element frame 90 and covers the swimming pool 30 may be used. Accordingly, the cover element 40 may be constructed from any material, may have any texture, color, dimension, and may include any number of additional components, such as support ribs or reinforcement materials.

The cover element 40 and cover element frame 90 are movable in a substantially vertical direction between a lowered position and a raised position. The lowered position is characterized as the position of the cover element 40 when it is proximate to the top surface 32 of the swimming pool. In other words, the lowered position may be when the cover element 40 is located substantially close to the pool deck 34, whereby the cover element 40 may prevent access to the swimming pool 30. The lowest position is when the cover element 40 and/or cover element frame 90 are in contact with the pool deck 34. The lowered position may also include positions where the cover element 40 is located a few inches from the pool deck 3. The raised position may be characterized as a position of the cover element 40 when it is remote from the top surface 32 of the swimming pool 30. FIG. 1 illustrates the cover element 40 in a raised position, where access is permitted to the swimming pool 30. The highest position is when the cover element 40 and cover element frame 90 is located as high above the swimming pool 30 as the support members 20 will permit. However, a raised position may also include a position when the cover element 40 is located a certain distance, such as two or three feet from the pool deck 34, whereby a small child or animal could still gain access to the swimming pool 30. The specific locations of a cover element frame 90 when in the raised and lowered positions, respectively, may be dependent on a specific design of the swimming pool cover apparatus 10.

At least one collapsible upper vertex 70 formed in the cover element 40. The upper vertex 70 may be characterized as any feature or features integral with, or proximate to at least a portion of the cover element 40, and preventing a quantity of precipitation from collecting on the cover element 40. In other words, the upper vertex 70 is a feature that forces rain, snow or other precipitation to move or flow away from the cover element 40, thereby preventing the precipitation matter from pooling and collecting on the cover element 40. Any number of upper vertexes 70 may be included within one cover element 40, depending on the size, location and other design features of the swimming pool cover apparatus 10. The upper vertex 70 is situated to collapse under a predetermined weight, whereby at least a portion of the cover element 40 abuts an upper water surface of the swimming pool 30 when the cover element frame 90 is in the lowered position, as discussed further with respect to FIGS. 2-5.

Movement of the cover element frame 90 is controlled with a vertical movement control system 60. The vertical movement control system 60 may include any system capable of controlling movement of the cover element frame 90, such as an electrical, mechanical, or counterbalancing system. Preferably, the vertical movement control system 60 will include a counterbalancing system providing a compensating force on the cover element frame 90. The compensating force may counteract the gravitational force or load of the cover element 40 and cover element frame 90, whereby the cover element 40 and cover element frame 90 are substantially balanced with the compensating force. A counterbalancing system may include compensating forces created from a fixed weight, an adjustable weight, a spring element having potential energy, or any other device or system commonly used in counterbalancing systems. One type of weight used as a counterbalance weight is an adjustable quantity of water that may be pumped to a water-tight housing affixed to the cover element 40 or cover element frame 90, discussed further with respect to FIG. 7.

The vertical movement control system 60 is located at least partially within one or more support members 20. For example, the vertical movement control system 60 may be located within a hollow interior portion of a support member 20, whereby a counterbalancing weight traverses along the length of the support member 20 in correspondence with the movement of the cover element 40. The vertical movement control system 60 may or may not be fully housed within the support members 20. Preferably, at least a portion of the vertical movement control system 60 will be located outside the support members 20 and affixed to the cover element. In FIG. 1, the vertical movement control system 60 is illustrated as having a plurality of pulley wheels 62 affixed to the outside of the support members 20 with a plurality of pulley cables 64 affixed to the cover element 40 or cover element frame 90. Although FIG. 1 illustrates the vertical movement control system 60 with pulley wheels 62 and pulley cables 64, any other components, devices or structures may also be used to facilitate movement of the cover element 40, as one having ordinary skill in the art would recognize. All variations and configurations are considered within the scope of the present disclosure.

Figure 2:
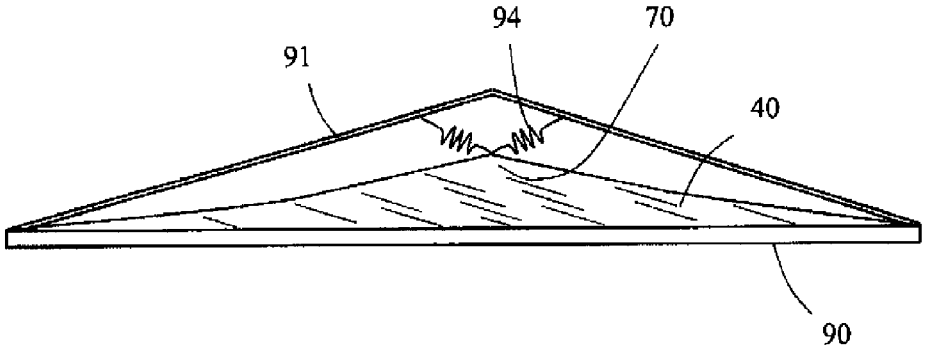
FIG. 2 is a cross-sectional illustration of the cover element of the swimming pool cover apparatus, in accordance with the first exemplary embodiment of the present disclosure.
Figure 3:
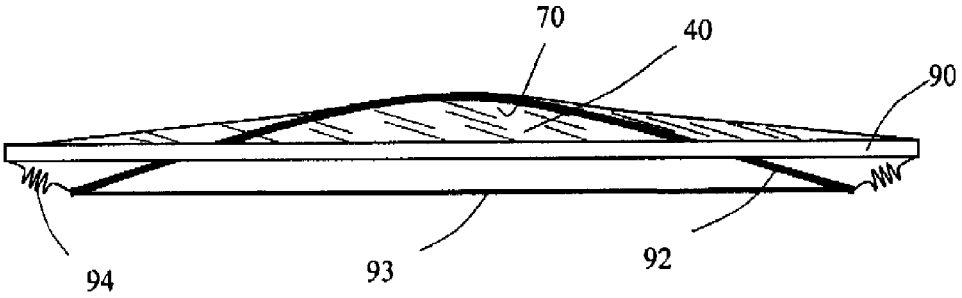
FIG. 3 is a cross-sectional illustration of the cover element of the swimming pool cover apparatus, in accordance with the first exemplary embodiment of the present disclosure.

FIGS. 2 and 3 are cross-sectional illustrations of the cover element 40 of the swimming pool cover apparatus 10, in accordance with the first exemplary embodiment of the present disclosure. The upper vertex 70 may be formed in a number of ways, all of which are considered within the scope of the present disclosure. For example, the upper vertex 70 may be formed using an upper frame 91 (FIG. 2) or spring-biased support 92 (FIG. 3) retaining a portion of the cover element 40 in a slightly elevated position. The upper frame 91 may include multiple frame structures, such as two perpendicular frame structures, and be located above the cover element frame 90 and be constructed from a material substantially similar to that of the cover element frame 90. However, the upper frame 91 may, in some instances, have different structural properties than the cover element frame 90. For example, the upper frame 91 may be constructed from substantially rigid but non-weight bearing materials that are strong enough to support the weight of the suspended cover element 40 (e.g., approximately 10 to 50 lbs), but not strong enough to support an additional weight.

The upper frame 91 may form the upper vertex 70 using one or more springs 94, whereby the upper vertex 70 may collapse when a weighted object is placed on the cover element 40. In one of many alternatives, the upper frame 91 may be constructed from flexible PVC tubes that allow the upper vertex 70 to collapse and use non-stretchable materials, such as rope or cables. This may eliminate the need to use one or more springs 94. The spring-biased support 92 may be constructed from any material, such as PVC tubing, but is preferably constructed from a substantially rigid material. Preferably, the spring-biased support 92 will be a material having enough rigidity to form the upper vertex 70. The upper vertex 70 may be collapsible when a weighted object is placed on the cover element 40, whereby the spring-biased support 94 is forced downward as allowed by one or more springs 94, discussed with respect to FIGS. 4 and 5.

As can be seen in FIG. 2, the upper frame 91 is positioned above the cover element 40 and uses a plurality of springs 94 to flexibly retain a portion of the cover element 40 in an elevated position. In FIG. 3, the spring-biased support 92 is positioned under the cover element 40 and biases a portion of the cover element 40 upwards using a plurality of springs 94 affixed between the frame 90 and the spring-biased support 92 A non-stretchable connecting element 93, which may include a rigid structure or a non-rigid structure, such as a rope, may connect the ends of the spring-biased support 94, as shown. Multiple spring-biased supports 92, such as two or more perpendicular structures may be used. As a skilled artisan within the industry would recognize, the upper vertex 70 may be formed in a variety of ways, using a variety of components and designs. For example, the upper vertex 70 may be formed using an external biasing device, such as an elastic cord, a spring, or a counterbalanced cable, affixed to between a portion of the cover element 40 and another structure located above the cover element 40. The external biasing device may elevate a portion of the cover element 40, thereby creating a slope within the cover element 40. All possible variations, designs and configurations of forming the upper vertex 70 are considered within the scope of this disclosure.

Figure 4:
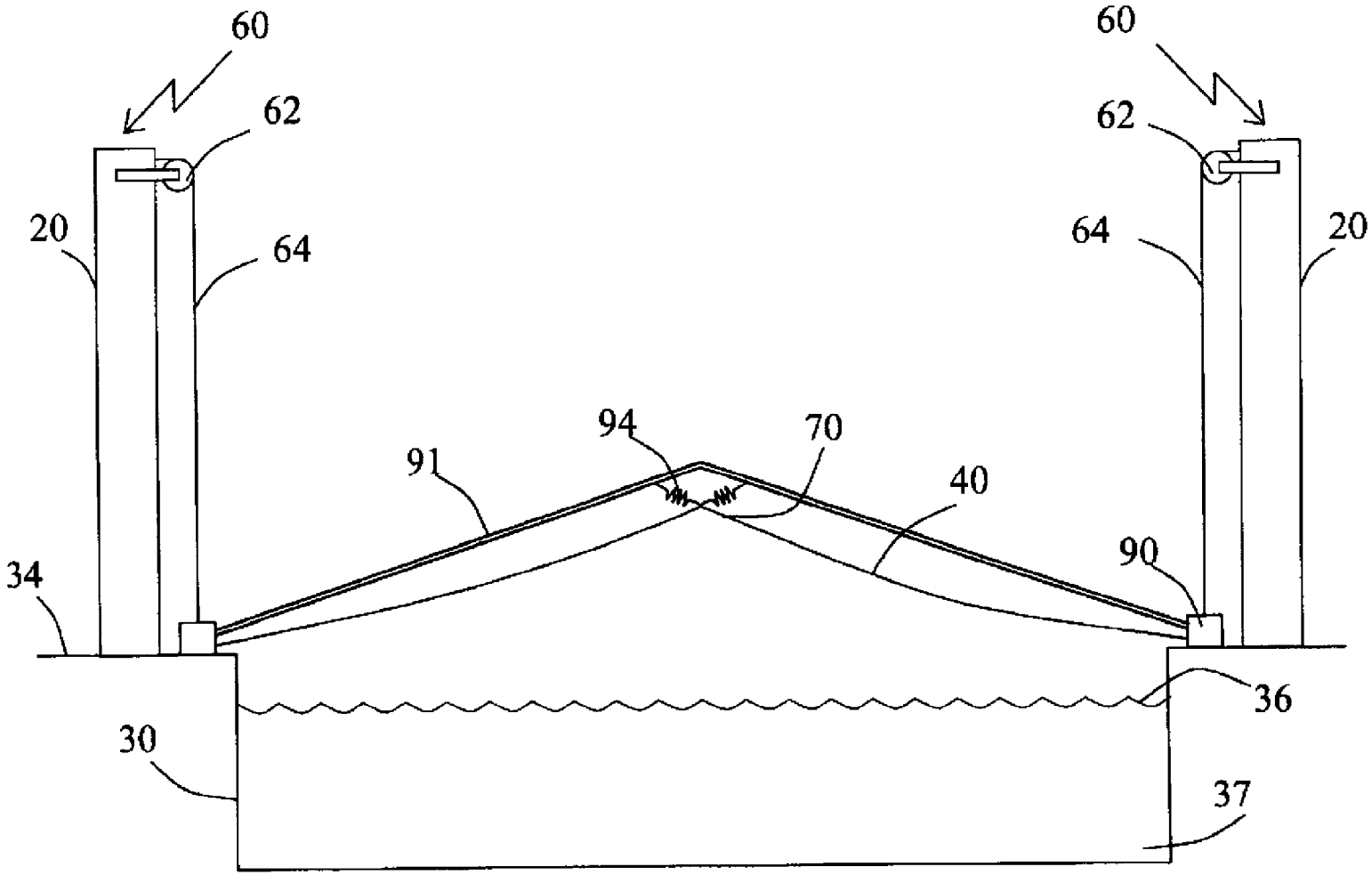
FIG. 4 is a cross-sectional illustration of the swimming pool cover apparatus in a lowered position, in accordance with the first exemplary embodiment of the present disclosure.
Figure 5:
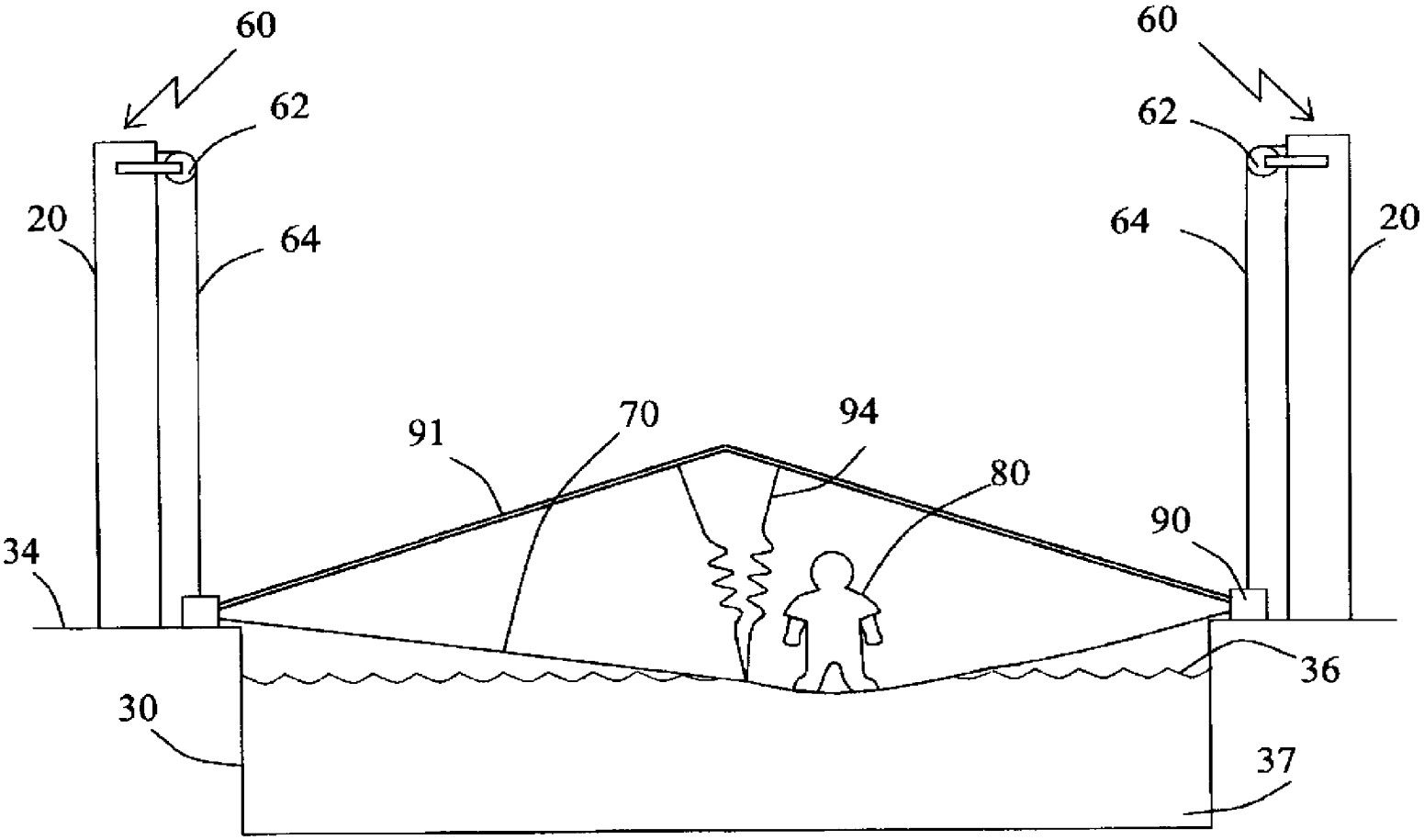
FIG. 5 is a cross-sectional illustration of the swimming pool cover apparatus in a lowered position, in accordance with the first exemplary embodiment of the present disclosure.

FIGS. 4 and 5 are cross-sectional illustrations of the swimming pool cover apparatus 10 in a lowered position, in accordance with the first exemplary embodiment of the present disclosure. More specifically, FIG. 4 illustrates the cover element 40 having an upper vertex 70 that is not subjected to a weighted object 80, and FIG. 5 illustrates the cover element 40 having an upper vertex 70 that has collapsed from a weighted object 80 placed on the cover element 40. As discussed with respect to FIGS. 1-3, the cover element 40 may include a frame 90 supporting the cover element 40. The vertical movement control system 60 raises and lowers the cover element 40 and cover element frame 90 through one or more pulley wheels 62 and pulley cables 64 and the upper vertex 70 is formed with an upper frame 91 and springs 94. The cover element 40 is located above the surface of the water 36 of the swimming pool 30, wherein the frame 90 is positioned low enough to the pool deck 34 whereby no access is permitted to the swimming pool 30. In this position, the cover element 40 prevents small children, pets, animals, or any objects from gaining access to the swimming pool 30.

When the swimming pool 30 is not is use, the cover element 40 may be kept in the lowered position restricting access to the swimming pool 30. The lowered cover element 40 may be kept in this position for any amount of time, such as a few minutes where children are left unattended in the general vicinity of the swimming pool 30 or for an extended period of time like during the winter months when the swimming pool 30 is not in use. The cover element 40 may be moved between the lowered position and a raised position with ease, as is discussed with respect to FIG. 6. A user of the swimming pool cover apparatus 10 may easily restrict access to the swimming pool 30, which may prevent accidents, injuries and even death, especially with small children.

FIG. 5 illustrates the swimming pool cover apparatus 10 when it is in the lowered position and a child or weighted object 80, is located on the cover element 40. The cover element 40 may be capable of restricting swimming pool 30 access to a variety of people and objects. Most preferably, the cover element 40 prevents a child or weighted object 80 from falling into the swimming pool 30 and sustaining injury. However, the cover element 40 may also prevent animals or objects, such as balls and sports equipment from falling into the swimming pool 30. In accordance with this disclosure, the cover element 40 may restrict access to the swimming pool 30 to any creature or physical object. As can be seen in FIG. 5, when a child or weighted object 80 steps or is moved onto the cover element 40, the upper vertex 70 is substantially eliminated as the cover element 40 is stretched to the surface of the water 36. In some cases, this may cause the upper frame 91 and springs 94 to become separated from the cover element 40, but it is preferable for the upper frame 91 and springs 94 to remain affixed to the cover element 40.

When the child or weighted object 80 is located on the cover element 40, the cover element 40 will make contact with or abut the surface of the water 36, thereby preventing the child or weighted object 80 from submerging in the water 37. This is primarily due to the fact that the cover element 40 is sufficiently stretched proximate to the cover element frame 90, whereby the water-displacement with surface tension effect can be achieved when the child or weighted object 80 is located on the cover element 40. The water-displacement with surface tension effect will permit the cover element 40 to support the weight of the child or weighted object 80. In this position, the cover element 40 may be able to support 10 times or more weight than the cover element 40 could support when not in contact with the water. Accordingly, the cover element 40 may also support a weight much higher than that of a child even when the cover element 40 is constructed from a material that is not known to be strong. This use of the water-displacement with surface tension effect permits a sufficiently stretched cover element 40 to support a weight that is many times greater than the strength of the material that the cover element 40 is constructed from. Without the cover element 40 stretched sufficiently in a configuration where the water-displacement with surface tension effect is achieved, the cover element 40 may fail to support the child or weighted object 80. The cover element 40 may support a variety of weights, including a small child having a weight of 20 lbs, 30 lbs, 50 lbs, 100 lbs or greater than 150 lbs, such as may be produced from a quantity of heavy snow.

To achieve water-displacement with surface tension effect the cover element 40 must be sufficiently stretched over the cover element frame 90. The ability of the cover element 40 to be stretched over the cover element frame 90 and collapse to contact the water surface, similar to a boat's hull, provides cover element 40 with a ability to support a weight that is multiple times great that what the cover element 40 material would support without being stretched over the cover element frame 90 and not contacting the water surface. For example, a cover element constructed from 10 mill-reinforced plastic (known as tarp) may easily withstands more than 100 lb per sq. foot when it is sufficiently stretched over the cover element frame 90 and is contacting the water surface. With the cover element 40 is in this configuration, it can withstand heavy weights and therefore may be used as a winter cover that may support heavy snow. To insure the maximum load capability the cover element 40 may be sufficiently stretched over the cover element frame 40. This may be achieved by the multitudes of springs that are evenly distributed over the perimeter of the cover element frame 90. The distance between springs and their force may depend on the size of the cover element 40 and its weight. For example a cover element that is 12 feet in diameter and used with a round pool may be constructed from a 10 ml., reinforced flexible material, such as a tarp, wherein the springs having approximately 10 lb of force are spaced at one foot intervals may support a weight of 150 lbs.

Figure 6:
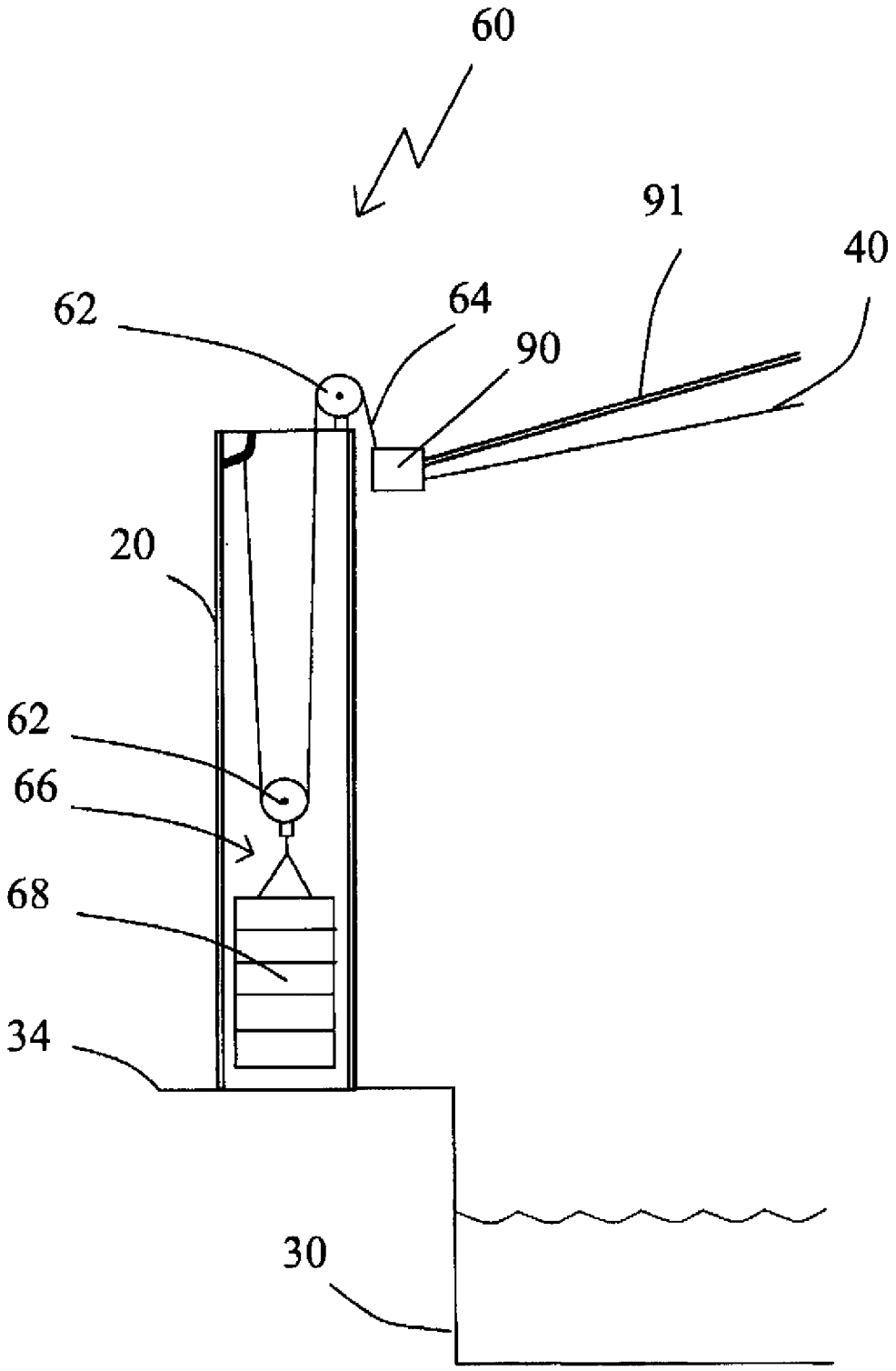
FIG. 6 is a cross-sectional illustration of the vertical movement control system, in accordance with the first exemplary embodiment of the present disclosure.

FIG. 6 is a cross-sectional illustration of the vertical movement control system 60, in accordance with the first exemplary embodiment of the present disclosure. As stated previously, the vertical movement control system 60 may employ a variety of movement system, such as counterbalancing systems. This may allow a single user the ability to raise and lower the cover element 40 with minimal effort. The vertical movement control system 60 of FIG. 6 includes a counterbalancing system 66 having a pulley wheel 62 located near the top of a support member 20. A pulley cable 64 is connected between the cover element frame 90 supporting the cover element 40 and the counterbalancing system 66. The counterbalancing system 66 includes one or more pulley wheels 62 connected to one or more counterbalancing weights 68. The counterbalancing weights 68 may include any type of weight, such as metal weights, a container with sand or a quantity of water, as discussed with respect to FIG. 7.

The counterbalancing weights 68 may be selected to substantially match the force created from the weight of the cover element frame 90 and cover element 40. In other words, the counterbalancing weights 68 may provide a compensating force on the cover element frame 90 and cover element 40 substantially equal to the force associated with the weight of the cover element frame 90 and cover element 40. In operation, the vertical movement of the cover element frame 90 and cover element 40 corresponds to the vertical movement of the counterbalancing weight 68. The pulley cable 64 facilitates the corresponding movement, whereby one end of the pulley cable 64 is secured in a stationary position and the other end is secured to the cover element frame 90 and cover element 40. Features and components of the counterbalancing system 66 may be adapted and adjusted as needed. For example, the size of the counterbalancing weights 68, the length and/or quantity of the pulley cable 64 and the number of pulley wheels 62 may be adjusted as needed.

Figure 7:
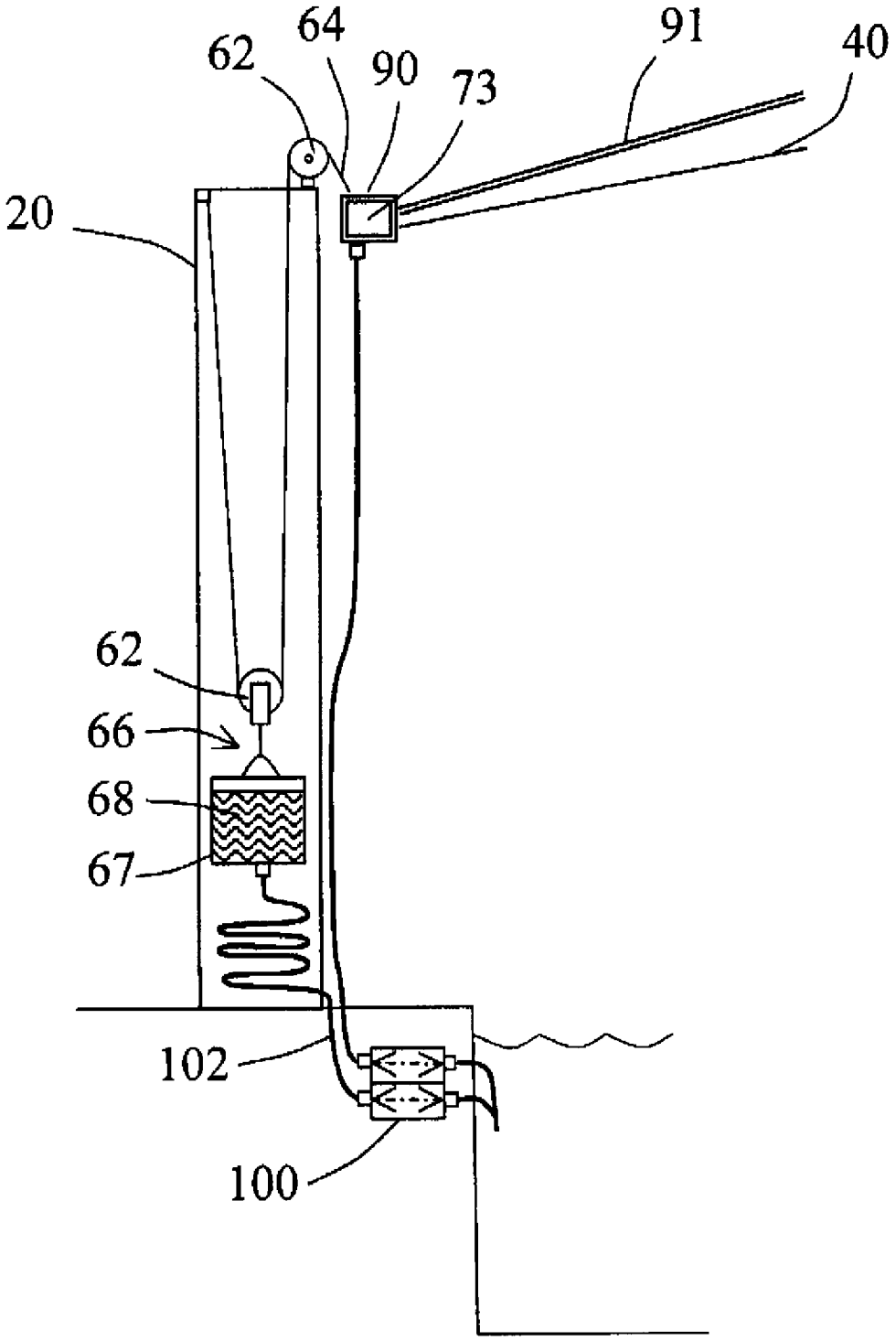
FIG. 7 is a cross-sectional illustration of the vertical movement control system, in accordance with the first exemplary embodiment of the present disclosure.

FIG. 7 is a cross-sectional illustration of the vertical movement control system 60, in accordance with the first exemplary embodiment of the present disclosure. The vertical movement control system 60 of FIG. 7 includes a counterbalancing system 66 utilizing water as the counterbalancing weight 68. Using water as a counterbalancing weight 68 performs in a similar manner to using a non-fluid weight. However, using water may allow the size of the counterbalancing weight 68 to be easily adjustable raising and lowering the cover element 40, such as automatic or power assist raising or lowering. For example, the counterbalancing system 66 may include a pump 100 with the multiport valves to achieve the multidirectional control of the flow of water through the counterbalancing system 66 and flexible tubing 102 to pump water from a water source to the container 67 holding the water acting as the counterbalancing weight 68. The counterbalancing system 66 may also pump water from the water source to an enclosed cavity 73 within the cover element frame 90. This configuration may allow water to easily be pumped from the swimming pool 30 into the container 67 or cavity 73, thereby adjusting the compensating force that the counterbalancing system 66 provides. The counterbalancing system 66 may use existing features of the swimming pool 30, such as the pump.

In some cases, fluid other than water may be needed to operate counterbalancing system 66. For example, to operate a heated pool, such as spa used in the wintertime, an anti-freeze fluid may be employed alone, or in combination with water, to prevent freezing. In addition, other systems of counterbalancing may be used with water as a counterbalancing weight. This may include filling the support members 20 with water and having a counterbalancing weight fully or partially float in the water. A number of variations, designs, and configurations may be included with the counterbalancing system 66 and the vertical movement control system 60, all of which are considered within the scope of this disclosure.

Figure 8:
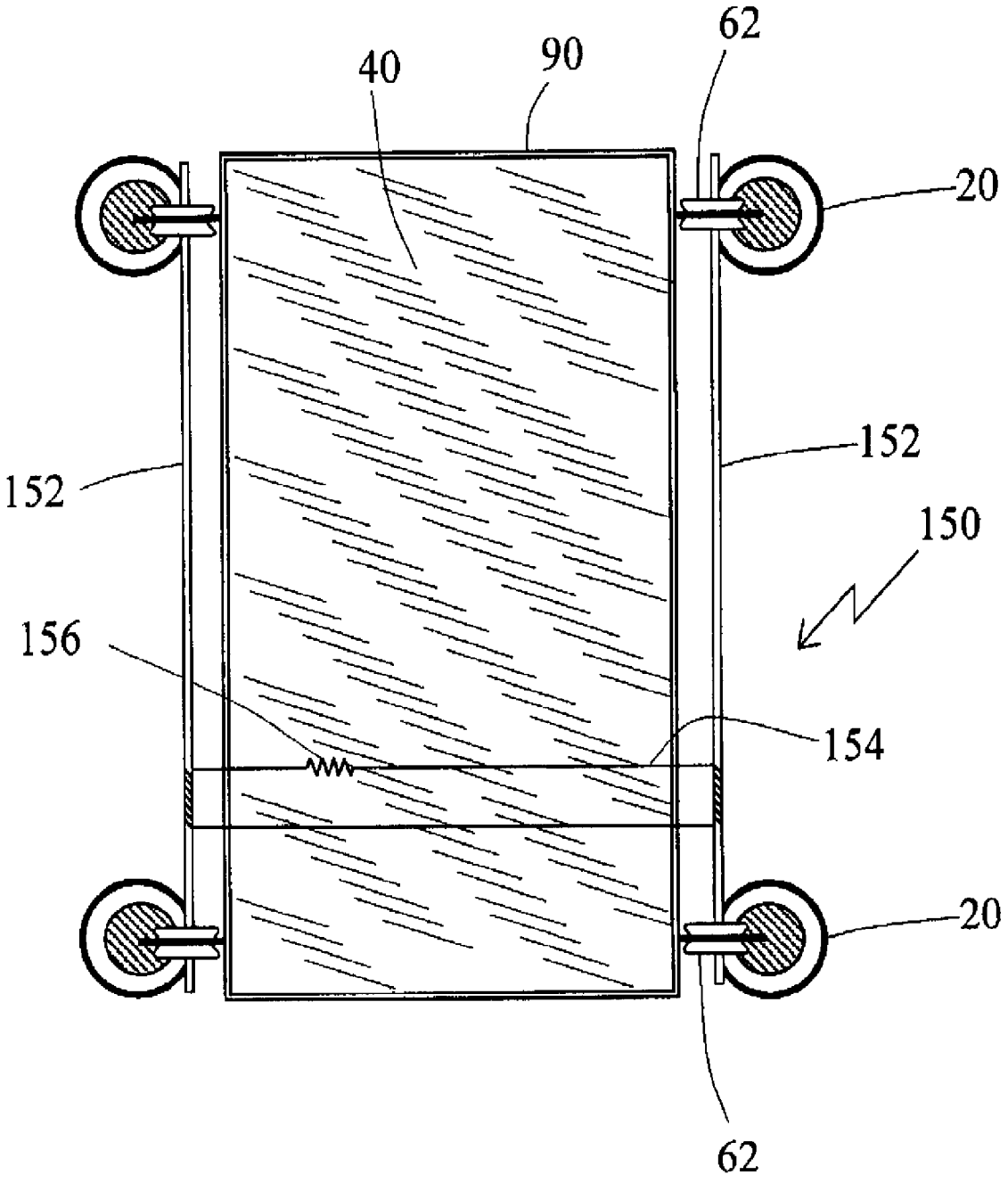
FIG. 8 is a top view cross-sectional illustration of a guiding system, in accordance with the first exemplary embodiment of the present disclosure.

FIG. 8 is a top view cross-sectional illustration of a synchronization system 150, in accordance with the first exemplary embodiment of the present disclosure. The synchronization system 150 may be employed with any type of vertical movement control system 60 described within this disclosure or otherwise known in the art, and my assist with synchronizing the vertical movement of the cover element 40. The synchronization system 150 includes two axles 152 connected between at least two pulley wheels 62. A synchronization belt 154 is connected between the two axles 152 and transfers the movement of one axle 152 to the other axle 152. The synchronization belt 154 may include a spring element 156 providing an appropriate tension. In use, the synchronization system 150 coordinates movement of the pulley wheels 62 and the pulley cables 64, thereby allowing all portions of the cover element 40 and cover element frame 90 to be raised and lowered at the same rate. This may prevent situations where the cover element 40 and cover element frame 90 become angled and are harder to move in a vertical direction, which may result in failure of the swimming pool cover apparatus 10.

Figure 9:
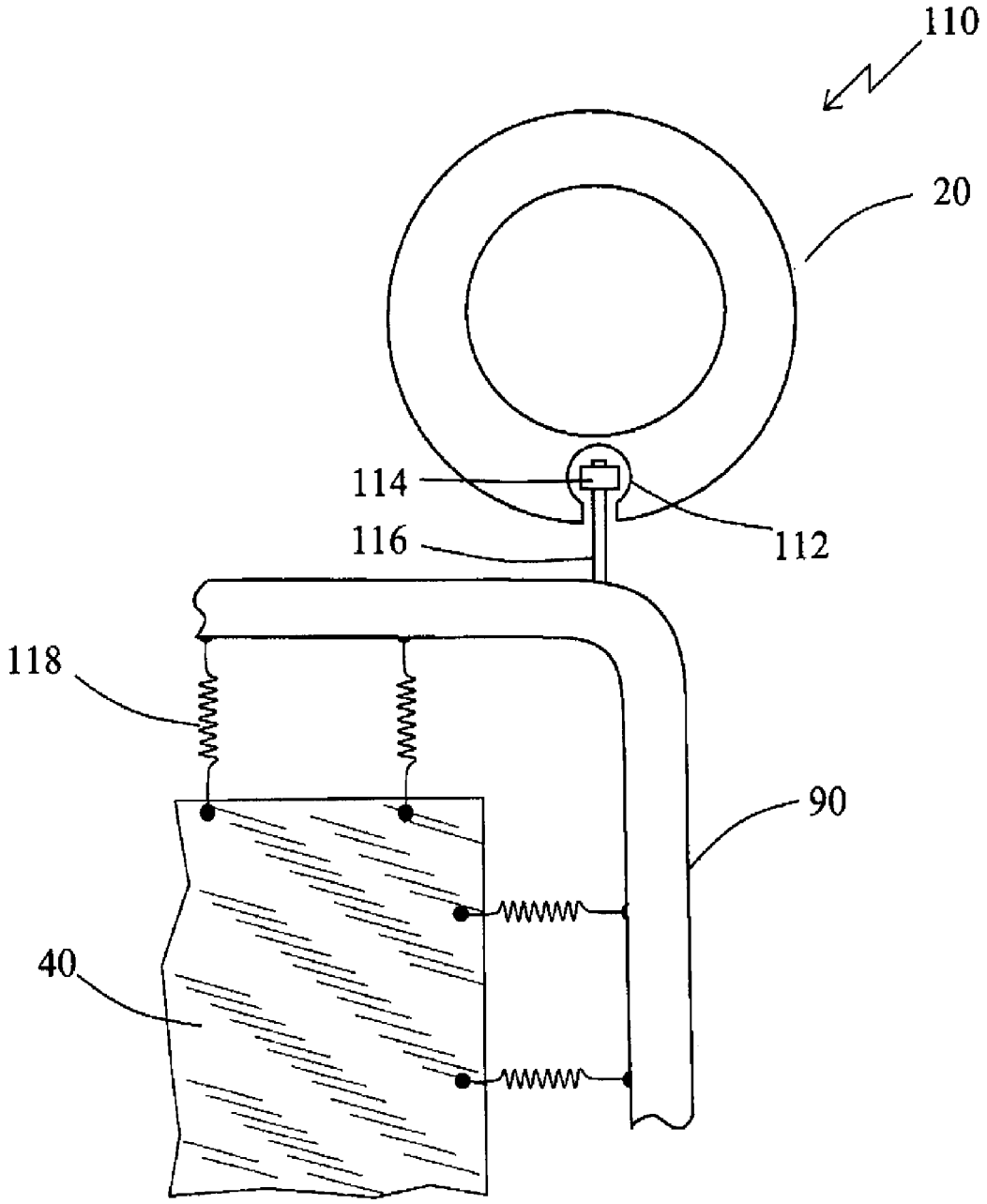
FIG. 9 is a top view cross-sectional illustration of a guiding system, in accordance with the first exemplary embodiment of the present disclosure.

FIG. 9 is a top view cross-sectional illustration of a guiding system 110, in accordance with the first exemplary embodiment of the present disclosure. The guiding system 110 may guide the cover element 40 and cover element frame 90 between the lowered position and the raised position during movement. The guiding system 110 may also prevent non-vertical movement of the cover element 40. The guiding system 110 includes a column guide 112 located integral with, or proximate to the support member 20. A guide wheel 114 is disposed within the column guide 112 and may traverse along the vertical length of the column guide 112. The guide wheel 114 is affixed to the cover element frame 90 with a guide wheel attachment 116 and the cover element frame 90 supports the cover element 40 with a plurality of tensioning springs 118. The tensioning springs 118 may retain the cover element 40 in a stretched or taut position.

The guiding system 110 may assist with raising and lowering the cover element 40 by providing a defined path of vertical movement. This may be especially helpful when the swimming pool cover apparatus 10 is used in windy conditions, which may subject the cover element 40, cover element frame 90 or any other component to high-stress conditions. As one having skill in the art can see, the guiding system 110 may be employed in a variety of ways, using a variety of components. For example, extruded plastic or aluminum channels may be affixed to an exterior surface of the support members 20. Likewise, architectural elements may be used to conceal unsightly features, such as the tensioning springs 118 or other components. Other variations and configurations are also possible, all of which are considered within the scope of this disclosure.

Figure 10:
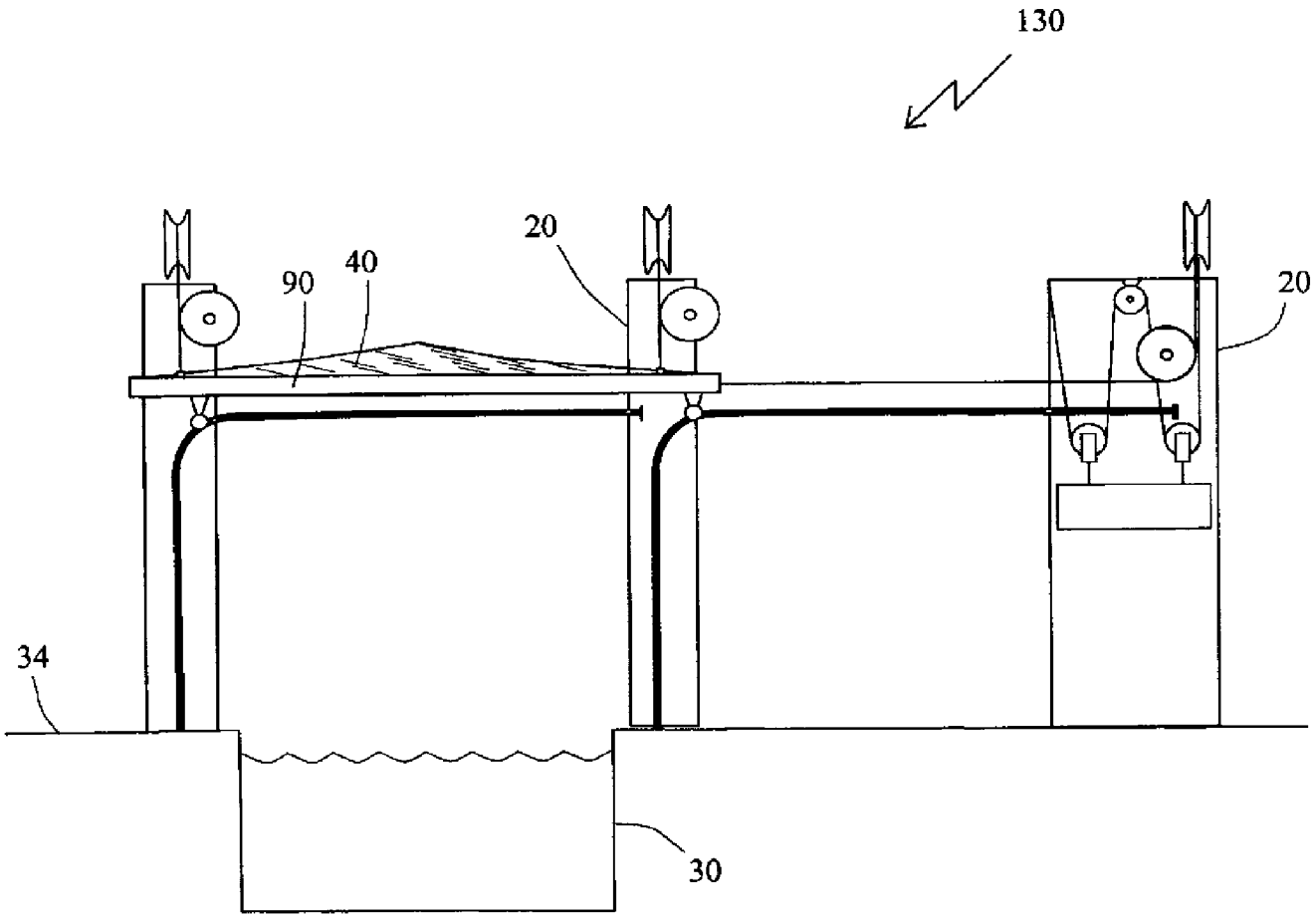
FIG. 10 is a cross-sectional illustration of a lateral movement system, in accordance with the first exemplary embodiment of the present disclosure.

FIG. 10 is a cross-sectional illustration of a lateral movement system 130, in accordance with the first exemplary embodiment of the present disclosure. The lateral movement system 130 may control the lateral movement of the cover element 40 and cover element frame 90 by providing removal of the cover element 40 and the cover element frame 90 from the above the swimming pool 30. This lateral movement may be characterized as movement between a first position substantially above the swimming pool 30 and a second position laterally remote from the first position. To accomplish this, the lateral movement system 130 may include additional support members 20 located in an area remote from the pool deck 34. However, the additional support member 20 may still be located sufficiently close to the pool deck 34 and swimming pool 30 to receive the cover element 40 and cover element frame 90 during lateral movement. In operation, the cover element 40 and cover element frame 90 are first moved to the raised position. The lateral movement system 130 may then move the cover element 40 and cover element frame 90 with a system of pulley wheels, pulley cables and guide rails. Similar to the vertical cover movement system 60, the lateral movement system may employ a counterbalance system using a system of weights.

Figure 11:
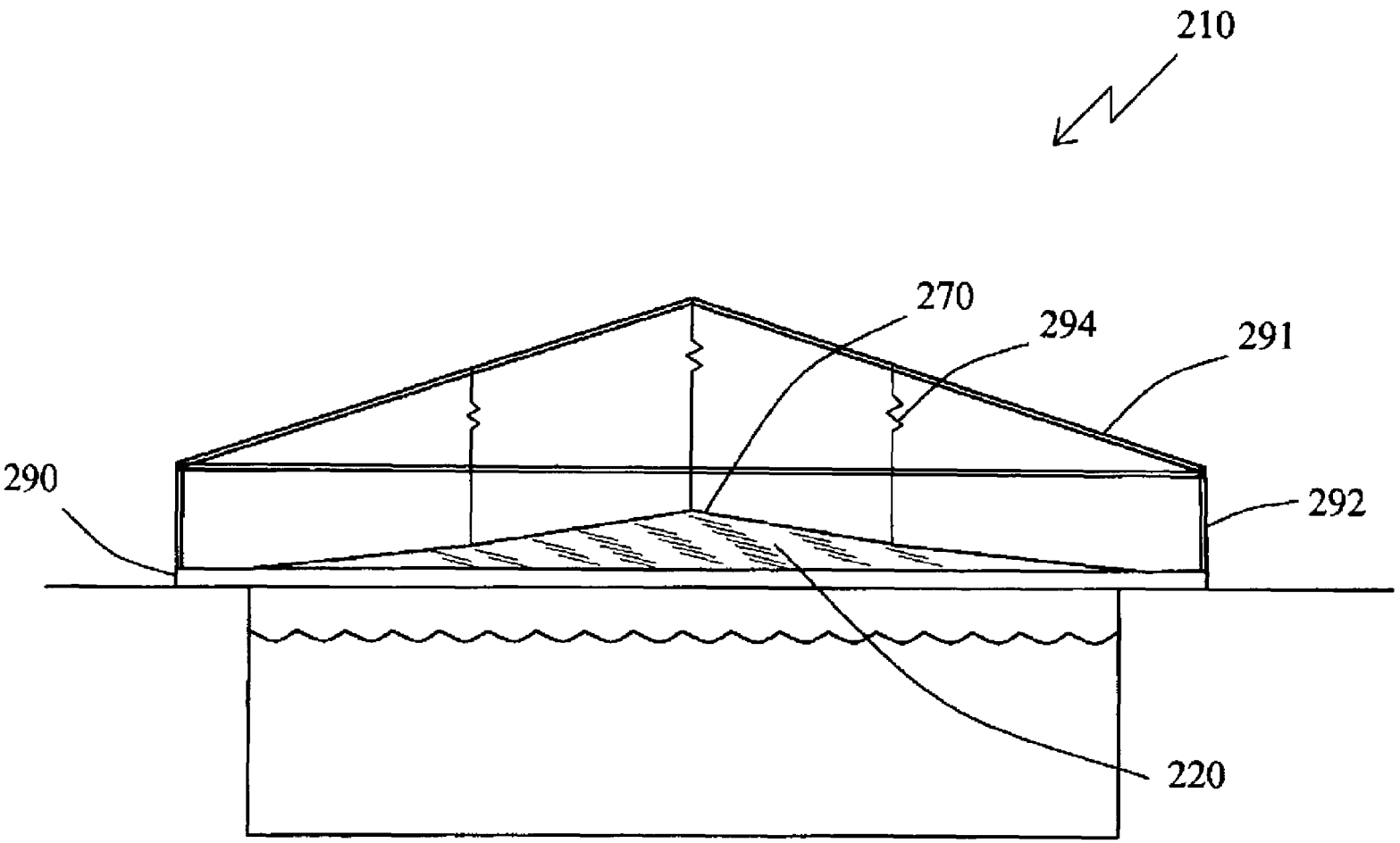
FIG. 11 is a cross-sectional illustration of a frame of a swimming pool cover apparatus, in accordance with a second exemplary embodiment of the present disclosure.

FIG. 11 is a cross-sectional illustration of a cover element frame 290 of a swimming pool cover apparatus 210, in accordance with a second exemplary embodiment of the present disclosure. The swimming pool cover apparatus 210 of the second exemplary embodiment is substantially similar to the swimming pool cover apparatus 10 of the first exemplary embodiment. Accordingly, any of the features, structures, components, designs and configurations discussed with respect to the first exemplary embodiment may be included in the second exemplary embodiment.

The swimming pool cover apparatus 210 includes a cover element frame 290 supporting a cover element 240 that is stretched proximate to the cover element frame 290, which is located substantially above a swimming pool (not shown). A vertical barrier 292 is affixed to the cover element frame 290 and rises vertically above the cover element frame 290 and cover element 240. An upper frame 291 is connected to the cover element frame 290 and/or the vertical barrier 292 and may include a spring device 294 connected to the cover element 240 creating an upper vertex 270. A screening material (not shown) may be stretched over the upper frame 291, and may provide shading to the pool area, as well as a secondary safety barrier over the swimming pool. The upper screen may be removed and stored as desired by the user, such as during the winter months when significant snowfall is expected.

The vertical barrier 292 may act as a vertical gate that traverses about the perimeter of the pool when the cover element frame 290 and cover element 240 are in the lowered position. The vertical barrier 292 may be constructed from the same material as the cover element frame 290, or a different material having different properties. For example, the vertical barrier 292 may be constructed from or reinforced with a built-in lightweight fence, and may be sufficiently high enough to prevent a child from climbing over it. If a child cannot gain access to the swimming pool beyond the vertical barrier 292, the upper frame 291 may be constructed with inexpensive, non-weight bearing materials like plastic or aluminum, which do not need to withstand the weight of a child. Preferably, the vertical barrier 292 is constructed in accordance with the American Society for Testing and Materials (ASTM), whereby it complies with ASTM F2286-05, Design and Performance Specification for Removable Mesh Fencing for Swimming Pools, Hot Tubs, and Spas.

Figure 12:
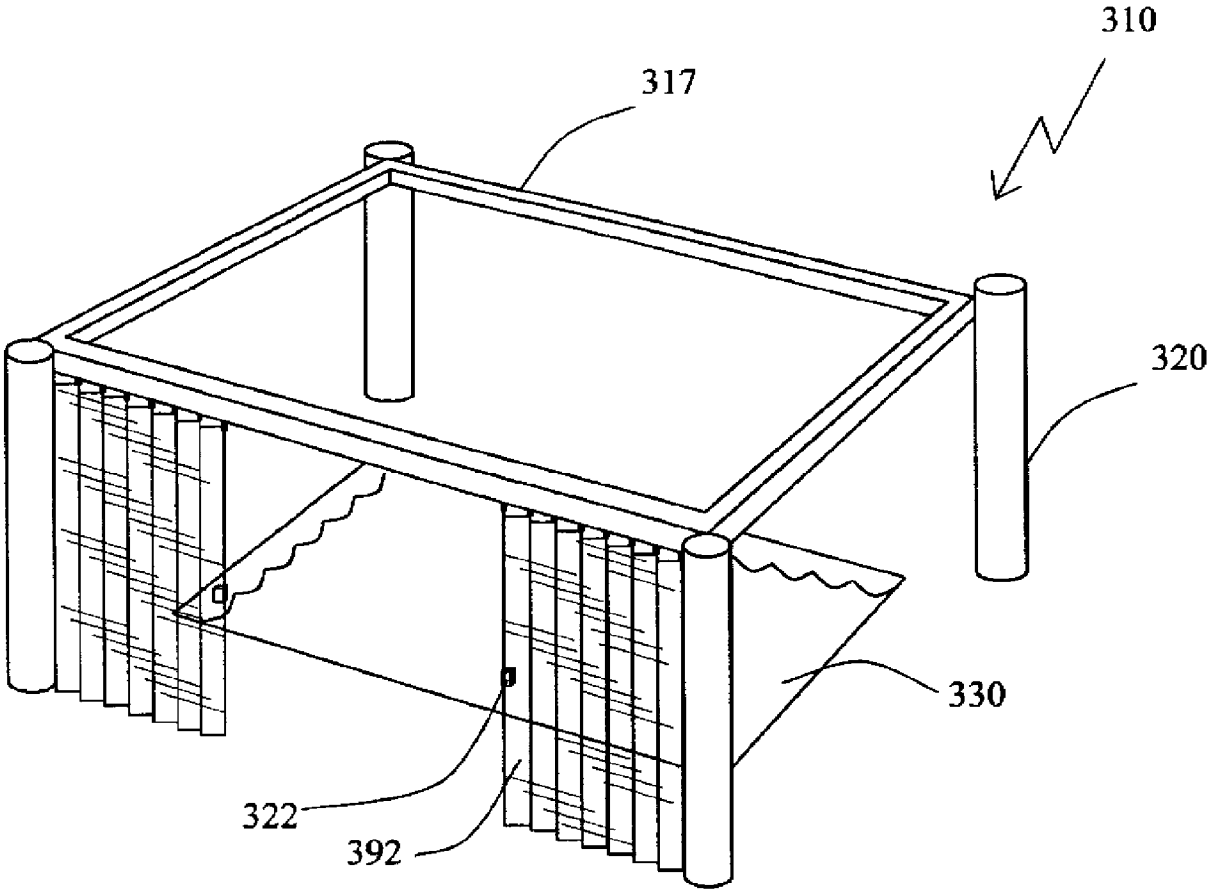
FIG. 12 is a plan view illustration of a swimming pool cover apparatus, in accordance with a third exemplary embodiment of the present disclosure.
Figure 13:
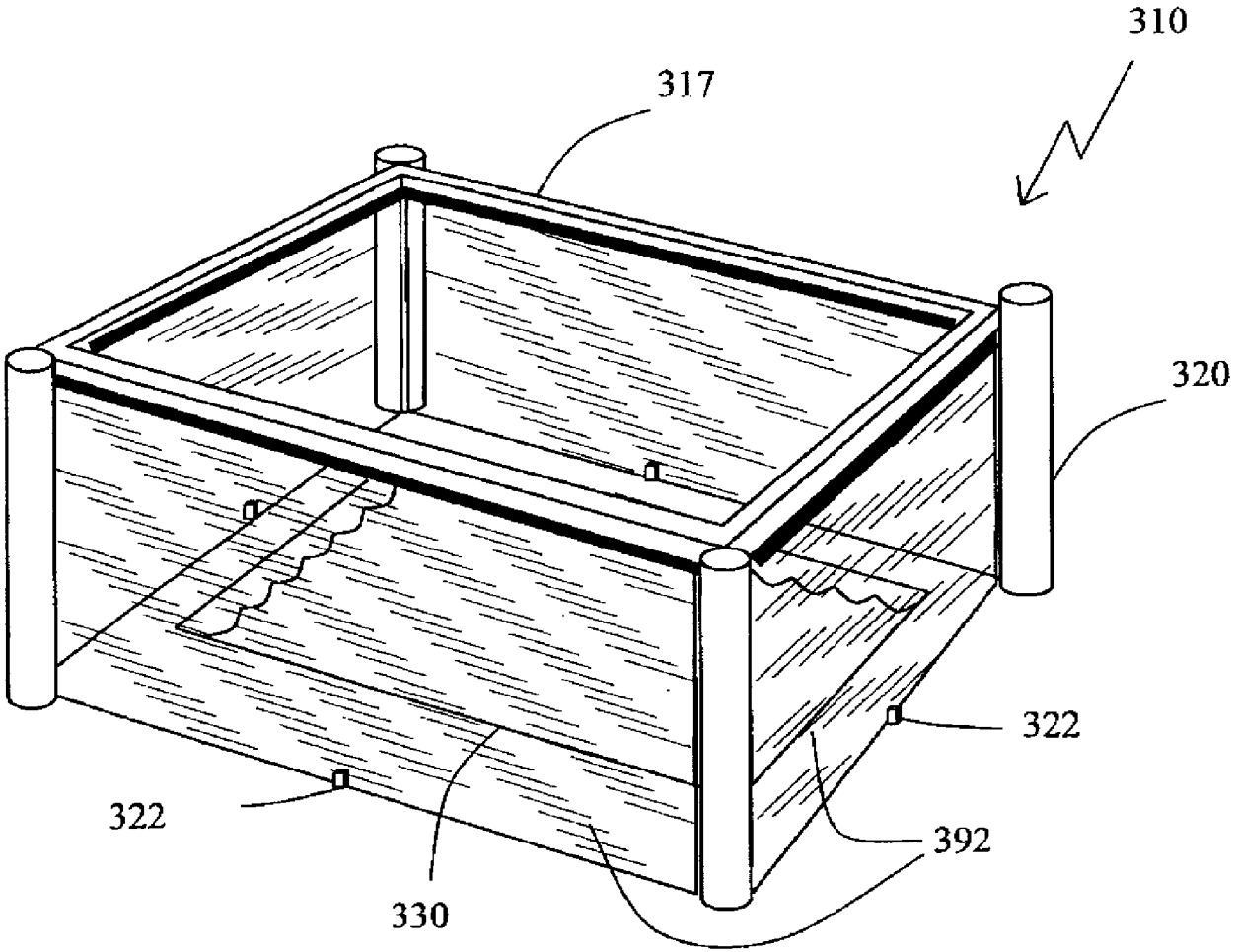
FIG. 13 is a plan view illustration of a swimming pool cover apparatus, in accordance with the third exemplary embodiment of the present disclosure.

FIGS. 12 and 13 are plan view illustrations of a swimming pool cover apparatus 310, in accordance with a third exemplary embodiment of the present disclosure. The swimming pool cover apparatus 310 of the third exemplary embodiment is substantially similar to the swimming pool cover apparatus 10, 210 of the first and second exemplary embodiments, respectively. Accordingly, any of the features, structures, components, designs and configurations discussed with respect to the first and second exemplary embodiments may be included in the third exemplary embodiment.

The swimming pool cover apparatus 310 may include one or more flexible barriers 392 located about a perimeter of the swimming pool 330. The flexible barriers 392 are movable between a closed position and an open position and may substantially enclose the swimming pool 330 when in the closed position. The flexible barriers 392 may be movable in a horizontal direction, as is shown in FIG. 12, or movable in a vertical direction, as is shown in FIG. 13. The flexible barriers 392 may be retractable between support members 320, or horizontal structural members 317. The flexible barriers 392 may be suspended from, supported by, or built in the support members 320 or the horizontal structural members 317. Fasteners, connectors or another connecting element, such as a fastener commonly used with drapery may be included to connect the flexible barriers 392 to the support members 320 or horizontal structural members 317. Alternatively, a retractable connector mechanism may be used to connect the flexible barrier 392 to a horizontal structural member 317 for vertical movement of the flexible barrier 392. The flexible barriers 392 can be moved between the open position and a closed position manually, using built-in electrical motors or using another device capable of moving the flexible barriers 392.

The flexible barriers 392 may be constructed from any flexible or foldable material, such as plastic. Preferably, the flexible barriers 392 are transparent and allow sunlight to enter the swimming pool 330. A locking device 322 may be employed to lock or fasten together two or more flexible barriers 392. The flexible barrier 392 may also be fastened or locked to a pool deck, a horizontal connecting structure 317 and a stationary support member 320. This may include any type of lock, such as a child-safe lock, a combination lock or a lock opened with a key, to name a few. FIG. 13 illustrates a vertically movable flexible barrier 392 locked to the pool deck with a locking device 322. This may be used to prevent unwanted access to the swimming pool 330. Preferably, the flexible barriers 392 are constructed from materials that are strong enough to prevent a child from gaining access to the swimming pool 330. The flexible barriers 392 may be constructed to comply with ASTM F2286-05.

The flexible barriers 392 may offer a number of benefits to a user of the swimming pool cover apparatus 310. One benefit is that when the flexible barriers 392 are used with the cover element (FIGS. 1-5) they provide multiple levels of protection against someone gaining access to the swimming pool 330 and subsequently incurring an injury. Although the flexible barriers 392 may be primarily used to prevent access to the swimming pool 330, they may also provide a benefit by substantially enclosing a pool while swimmers are inside, thereby creating a virtual indoor pool. Specifically, when the flexible barriers 392 are used with the cover element (FIGS. 1-5), the swimming pool 330 is converted into a virtual indoor pool with the cover element as a roof and the flexible barriers 392 as walls. This may provide a warmer water temperature due to the solar heating, which may significantly extend the swimming season in colder climates. Additionally, this may provide a means of blocking out sunlight, especially in combination with an upper screen, to prevent sunburns or providing more privacy to a swimming pool.

Figure 14:
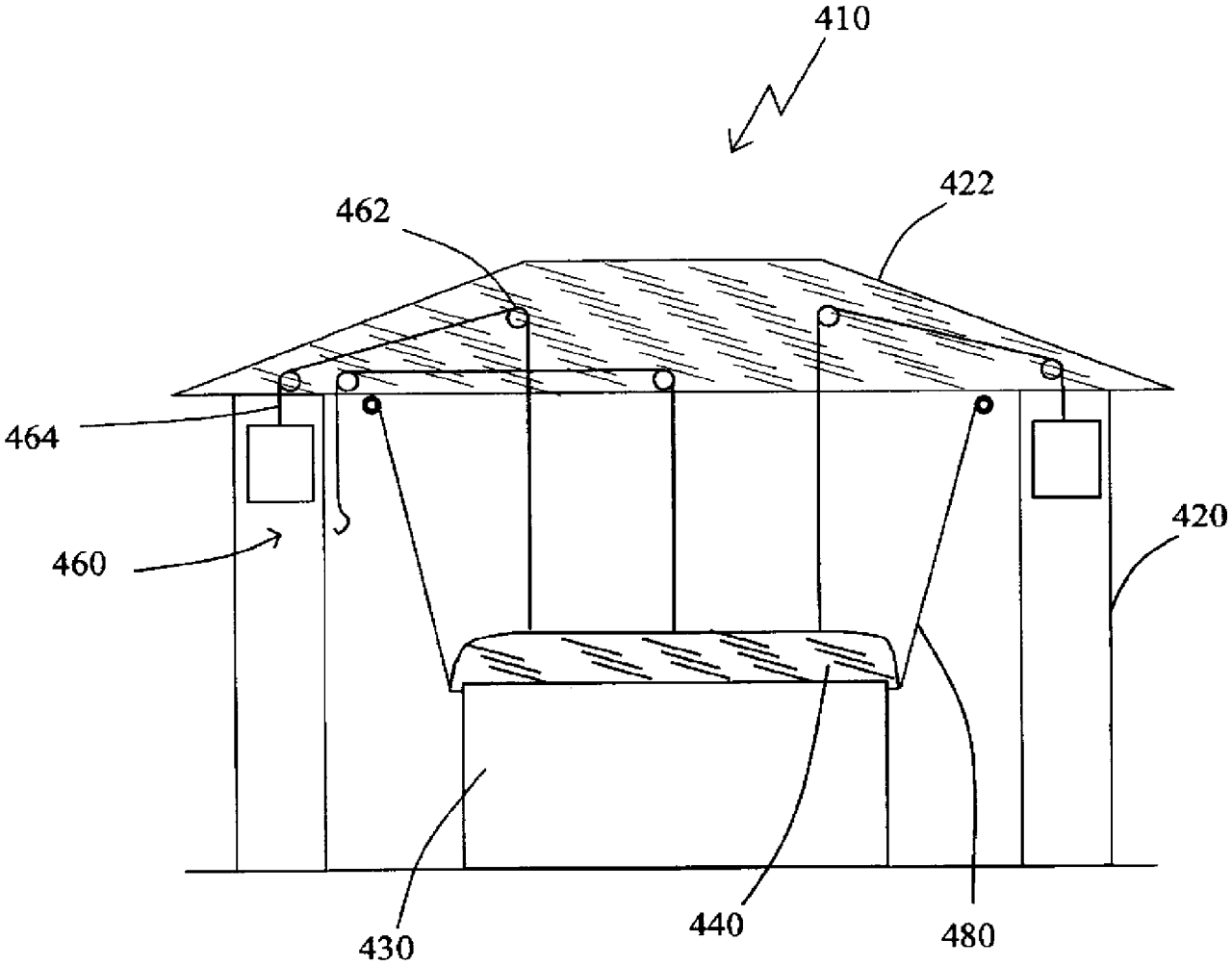
FIG. 14 is a cross-sectional illustration of a spa cover apparatus, in accordance with a fourth exemplary embodiment of the present disclosure.

FIG. 14 is a cross-sectional illustration of a spa cover apparatus 410, in accordance with a fourth exemplary embodiment of the present disclosure. The spa cover apparatus 410 of the fourth exemplary embodiment is substantially similar to the swimming pool cover apparatus 10 and 310 of the first and third exemplary embodiments, respectively. Accordingly, any of the features, structures, components, designs and configurations discussed with respect to the first and third exemplary embodiments may be included in the fourth exemplary embodiment. The primary difference between the spa cover apparatus 410 of the fourth exemplary embodiment and previous embodiments is that the spa cover apparatus 410 is design to be used with spas. Spas are frequently found located outdoors on a deck or patio of a residence, where they are used year-round if they are equipped with a heating device. Accordingly, the principle operation, use and structure of the spa cover apparatus 410 are the same as described previously herein.

The spa cover apparatus 410 includes a plurality of support members 420 with a roof structure 422 located above a spa 430. The roof structure 422 may include any structure, such as a permanent structure, semi-permanent structure or a frame structure covered with a transparent sheeting material. A cover element 440 is located above the spa 430 and below the roof structure 422. The cover element 440 may be constructed with any type of material and preferably includes at least a substantially transparent material. The cover element 440 is retained in place with a vertical movement system 460 that includes a plurality of pulley wheels 462 and pulley cables 464. The vertical movement system 460 may be operable with any type of movement mechanism, such as a counterbalancing system, shown in FIGS. 6 and 7. The counterbalancing system may operate in the same manner as described in the first exemplary embodiment, wherein the cover element 440 is raised and lowered in a vertical direction using a counterbalancing weight.

The spa cover apparatus 410 may also include a reflective retractable screen 480 located proximate to the spa 430 and providing a surface for sunlight reflection onto the spa 430. This may be beneficial by directing more solar energy to the spa, thereby providing natural heat in addition to any artificial heating system. The reflective retractable screen 480 may be affixed between the spa 430 and any other structure of the spa cover apparatus 410, such as the support members 420 or the roof structure 422. The reflective retractable screen 480 may be movable with the cover element 440 between an open position and a closed position, wherein a user would not have to perform additional steps to retract the reflective retractable screen 480 while open the spa 430. Furthermore, the spa cover apparatus 410 may include flexible or nonflexible barriers (described with respect to FIGS. 11-13), or any other component described within this disclosure.

Figure 15:
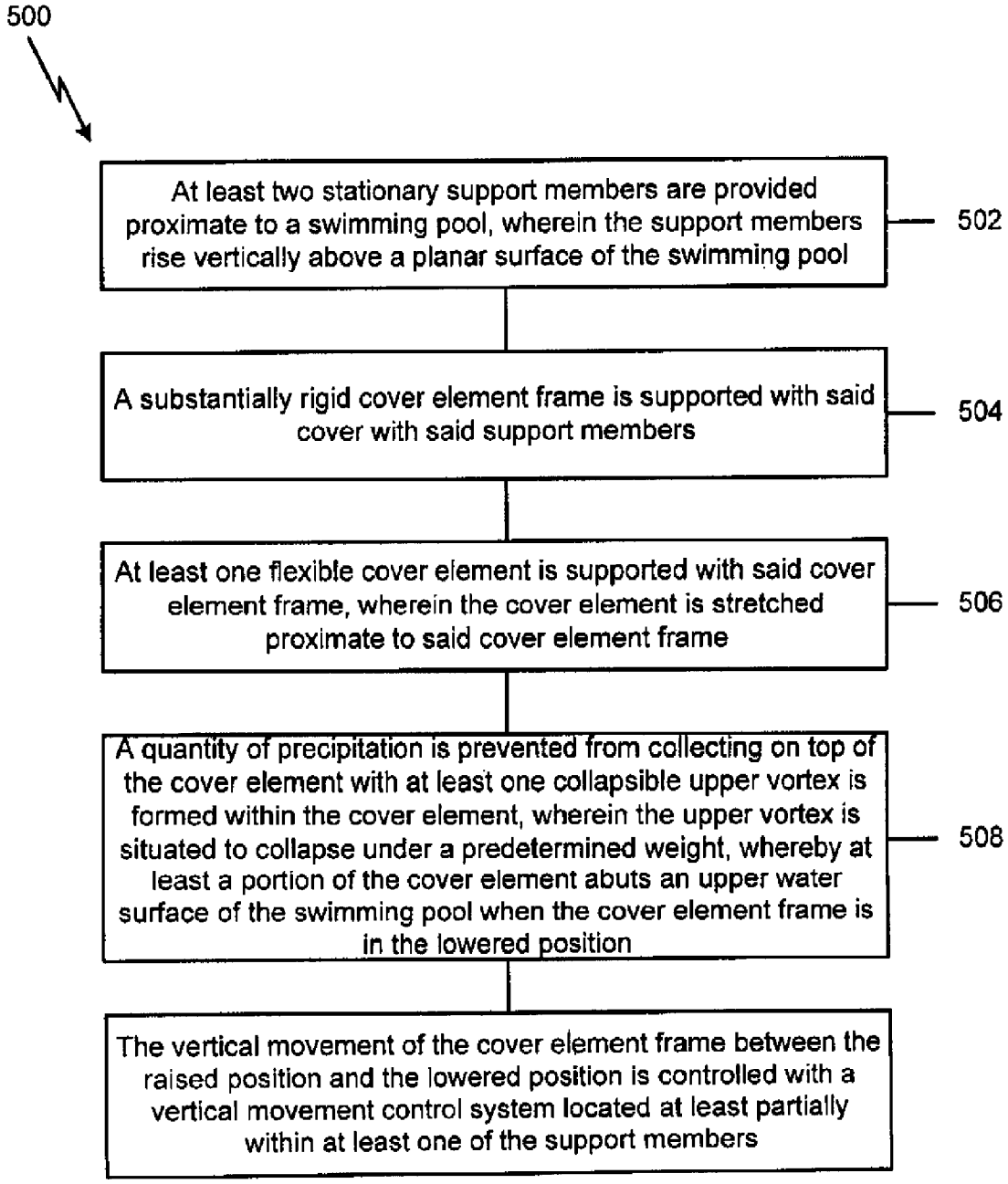
FIG. 15 is a flowchart illustrating a method of covering a swimming pool, in accordance with the first exemplary embodiment of the disclosure.

FIG. 15 is a flowchart 500 illustrating a method of covering a swimming pool, in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 502, at least two stationary support members are provided proximate to a swimming pool, wherein the support members rise vertically above a planar surface of the swimming pool. A substantially rigid cover element frame is supported with said support members (block 504). At least one flexible cover element is support with said cover element frame, wherein the cover element is stretched proximate to said cover element frame (block 506). A quantity of precipitation is prevented from collecting on top of the cover element with at least one collapsible upper vertex is formed within the cover element, wherein the upper vertex is situated to collapse under a predetermined weight, whereby at least a portion of the cover element abuts an upper water surface of the swimming pool when the cover element frame is in the lowered position (block 508). The vertical movement of the cover element frame between the raised position and the lowered position is controlled with a vertical movement control system located at least partially within at least one of the support members (block 510). The method of covering a swimming pool may also include additional steps, including any number of additional steps to perform the movement and actions described with respect to any of the first through fourth exemplary embodiments of this disclosure. For example, the method of covering a swimming pool may include moving the cover element in a substantially vertical direction between the lowered position proximate to the top surface of the swimming pool and the raised position remote from the top surface of the swimming pool. This vertical movement may be controlled with a vertical movement control system located at least partially within at least one of the support members.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A swimming pool cover apparatus, comprising:

at least two stationary support members located proximate to a swimming pool and rising vertically above a top surface of the swimming pool;

a substantially rigid cover element frame supported by said support members and movable in a substantially vertical direction between a lowered position proximate to the top surface of the swimming pool and a raised position remote from the top surface of the swimming pool;

at least one flexible cover element supported by said cover element frame, wherein the flexible cover element is stretched proximate to said cover element frame, and wherein the at least one flexible cover element is free from contact with the cover element frame along a footprint of the at least one flexible cover element;

at least one collapsible upper vertex formed within the cover element with at least one biasing device connected between a spring-biased support and the cover element frame, the spring-biased support further comprising an upwardly curved, rigid spring-biased support positioned below the at least one flexible cover element, wherein the upwardly curved, rigid spring-biased support is movably connected to the cover element frame with at least two springs positioned on opposing sides of the upwardly curved, rigid spring-biased support, wherein the upper vertex prevents a quantity of precipitation from collecting on top of the cover element, wherein the upper vertex is situated to collapse under a predetermined weight, whereby the upwardly curved, rigid spring-biased support is biased into a quantity of water within the swimming pool and at least a portion of the cover element abuts an upper water surface of the swimming pool when the cover element frame is in the lowered position; and a vertical movement control system located at least partially within at least one of the support members, the vertical movement control system controlling a vertical movement of the cover element frame between the lowered position and the raised position.

2. The swimming pool cover apparatus of claim 1, wherein the vertical movement control system further comprises a counterbalancing system providing a compensating force on the cover element, wherein the compensating force is approximately equal to a force associated with the weight of at least one of the cover element and cover element frame.

3. The swimming pool cover apparatus of claim 2, wherein the counterbalancing system includes at least one of a counterbalancing weight and a spring mechanism.

4. The swimming pool cover apparatus of claim 3, wherein the counterbalancing weight includes an adjustable quantity of water.

5. The swimming pool cover apparatus of claim 4, wherein adjustable quantity of water is adjusted with a swimming pool pump, wherein the swimming pool pump is situated to adjust the adjustable quantity of water with a quantity of water pumped from the swimming pool.

6. The swimming pool cover apparatus of claim 4, wherein the substantially rigid cover element frame includes an enclosed cavity within one or more members of the cover element frame, wherein the enclosed cavity is filled with a quantity of water to adjust the compensating force provided by the counterbalancing system.

7. The swimming pool apparatus of claim 1, wherein the cover element abutting the upper water surface of the swimming pool supports a weight greater than what the cover element is capable of supporting when the cover element is not abutting the upper water surface of the swimming pool.

8. The swimming pool cover apparatus of claim 7, wherein the cover element abutting the upper water surface of the swimming pool supports a weight at least 10 times greater than what the cover element is capable of supporting when the cover element is not abutting the upper water surface of the swimming pool.

9. The swimming pool cover apparatus of claim 1, wherein the at least one collapsible upper vertex is retractable to an elevated position with the at least one biasing device.

10. The swimming pool cover apparatus of claim 1, wherein the upwardly curved, rigid spring-biased support further comprises a rigid connecting element connected between the opposing sides of the upwardly curved, rigid spring-biased support, wherein the at least two springs are connected proximate to a joint of the upwardly curved, rigid spring-biased support with the rigid connecting element on each side, respectively, wherein the spring-biased support contacts the cover element to form the at least one collapsible upper vertex.

11. A method of covering a swimming pool comprising the steps of:

providing at least two stationary support members proximate to a swimming pool, wherein the support members rise vertically above a surface of a swimming pool deck, wherein the surface of the swimming pool deck is about an upper surface of a quantity of water within the swimming pool;

supporting a substantially rigid cover element frame with said support members, whereby the substantially rigid cover element frame is movable between raised and lowered positions, and wherein in the lowered position the substantially rigid cover element frame contacts the surface of the swimming pool deck;

supporting at least one flexible cover element with said cover element frame only along a perimeter of the at least one flexible cover element, wherein the at least one flexible cover element is free from contact with the rigid cover element frame along a footprint of the at least one flexible cover element, wherein the flexible cover element is stretched proximate to rigid said cover element frame;

forming at least one collapsible upper vertex within the cover element with at least one biasing device;

collapsing the upper vertex under a predetermined weight positioned on the at least one flexible cover element when the cover element frame is in the lowered position, whereby at least a portion of the cover element extends below an entirety of the substantially rigid cover element frame and the surface of the swimming pool deck, and contacts the upper water surface of the swimming pool, whereby the predetermined weight is supported on the at least one flexible cover element in contact with the upper water surface.

12. The method of covering a swimming pool of claim 11, further comprising the steps of:

moving the cover element frame in a substantially vertical direction between the lowered position proximate to the top surface of the swimming pool deck and the raised position remote from the top surface of the swimming pool deck; and controlling a vertical movement of the cover element frame between the lowered position and the raised position with a vertical movement control system located at least partially within at least one of the support members.

13. The method of covering a swimming pool of claim 11, further comprising the step of:

retracting the at least one collapsible upper vertex from a collapsed position to an elevated position after the predetermined weight is removed from the at least one collapsible upper vertex, thereby moving the at least one biasing device from a biased position to an original position.

14. The method of covering a swimming pool of claim 11, wherein the step of forming the at least one collapsible upper vertex within the cover element with at least one biasing device further comprises directly connecting the at least one biasing device between the cover element and the cover element frame.

15. The method of covering a swimming pool of claim 11, wherein the step of forming the at least one collapsible upper vertex within the cover element with at least one biasing device further comprises connecting the at least one biasing device between the spring-biased support and the cover element frame, wherein the spring-biased support further comprises an upwardly curved, rigid spring-biased support positioned below the at least one flexible cover element, wherein the upwardly curved, rigid spring-biased support is movably connected to the cover element frame with at least two springs positioned on opposing sides of the upwardly curved, rigid spring-biased support, and wherein the spring-biased support contacts the cover element to form the at least one collapsible upper vertex.

16. A swimming pool cover apparatus, comprising:

at least two stationary support members located proximate to a swimming pool and rising vertically above a top surface of the swimming pool;

a substantially rigid cover element frame supported by said support members and movable in a substantially vertical direction between a lowered position proximate to the top surface of the swimming pool and a raised position remote from the top surface of the swimming pool;

at least one flexible cover element supported by said cover element frame only along a perimeter of the at least one flexible cover element, wherein the at least one flexible cover element is free from contact with the cover element frame along a footprint of the at least one flexible cover element, wherein the flexible cover element is stretched proximate to said cover element frame;

an upper frame connected to the cover element frame, the upper frame having at least two legs extending from the cover element frame and above the at least one flexible cover element, wherein the at least two legs connect at a peak positioned a spaced distance above a middle of the at least one flexible cover element;

at least one collapsible upper vertex formed within the cover element with at least two biasing devices, each connected between the at least one flexible cover element and one of the at least two legs of the upper frame in a position offset from the peak, the upper vertex preventing a quantity of precipitation from collecting on top of the cover element, wherein the upper vertex is situated to collapse under a predetermined weight, whereby at least a portion of the cover element abuts an upper water surface of the swimming pool when the cover element frame is in the lowered position; and a vertical movement control system located at least partially within at least one of the support members, the vertical movement control system controlling a vertical movement of the cover element frame between the lowered position and the raised position.

* * * * *